United States Patent [19]

Hayes et al.

[11] Patent Number: 4,458,973

[45] Date of Patent: Jul. 10, 1984

[54] CONNECTOR ASSEMBLY HAVING IMPROVED INTERNAL LATCHING SYSTEM

[75] Inventors: Earl J. Hayes, Mechanicsburg; Charles H. Weidler, Lancaster, both of Pa.

[73] Assignee: AMP Incorporated, Harrisburg, Pa.

[21] Appl. No.: 461,786

[22] Filed: Jan. 28, 1983

[51] Int. Cl.[3] ..... H01R 13/627

[52] U.S. Cl. ..... 339/91 R

[58] Field of Search ..... 339/91 R

[56] References Cited

U.S. PATENT DOCUMENTS

| | | | |
|---|---|---|---|
| 3,310,772 | 3/1967 | Kirk et al. | 339/91 R |
| 3,860,316 | 1/1975 | Hardesty | 339/91 R |
| 4,231,628 | 11/1980 | Hughes et al. | 339/91 R |
| 4,406,509 | 9/1983 | Jagen | 339/91 R |

FOREIGN PATENT DOCUMENTS

| | | | |
|---|---|---|---|
| 2018048 | 10/1979 | United Kingdom | 339/91 R |

*Primary Examiner*—John McQuade

*Attorney, Agent, or Firm*—F. W. Raring

[57] ABSTRACT

Electrical connector assembly comprises a plug and a receptacle which has a plug receiving opening extending into its mating face. The plug has latch arms extending from its endwalls adjacent to the leading end of the plug. The latch arms extend divergently and have rearwardly facing shoulders intermediate the ends and handle portions extending from the shoulders to the free ends. Ears extend from the free ends towards the endwalls and are offset from the adjacent plug sidewall so that the latch arms can be flexed towards the plug endwalls for unlatching. The receptacle opening has shoulders therein for engagement with the plug shoulders.

7 Claims, 5 Drawing Figures

CONNECTOR ASSEMBLY HAVING IMPROVED INTERNAL LATCHING SYSTEM

FIELD OF THE INVENTION

This invention relates to an electrical connector assembly of the type comprising a plug and a receptacle, the receptacle having a plug receiving opening extending inwardly from its mating face. The invention is particularly directed to the achievement of a plug which can be produced in relatively small sizes and which has a latching system for latching the plug to the receptacle.

BACKGROUND OF THE INVENTION

U.S. Pat. No. 3,860,316 shows a connector assembly comprising a connector plug and a connector receptacle which has a plug receiving opening extending inwardly from its mating face. The plug has contact terminals therein having contact portions on one of the plug sidewalls adjacent to the leading or mating end of the plug and the receptacle has receptacle contacts comprising cantilever spring arms which are engaged by the plug contacts. When the parts are mated, the plug and receptacle are latched to each other by means of a latch arm provided on the plug sidewall which is opposite to the sidewall on which the contacts are provided. A complementary receptacle latch is provided on the opening sidewall of the receptacle. The latching shoulders of the plug and the receptacle are therefore within the plug receiving opening of the receptacle and the overall dimensions of the connector assembly can be quite small as a result. Furthermore, the latching mechanism, being inside the plug receiving opening of the receptacle, is protected from damage. Connector assemblies of the type shown in U.S. Pat. No. 3,860,316 are widely used in telephone equipment and related equipment. Connector assemblies of this type are produced with four to eight contact terminals but are not made in larger sizes.

It would be desirable to produce connector assemblies of the type described above which would be suitable for use with computers and computer-related equipment, however, it would be necessary to provide a range of sizes for varying numbers of conductors. The latching system used with connector assemblies of the type described in U.S. Pat. No. 3,860,316 would not be satisfactory for assemblies designed to connect more than about eight conductors, that is, they would not be satisfactory if the plug and receptacle were significantly wider than the plugs and receptacle presently being used. The present invention is thus directed to the achievement of an improved latching system which does permit the design of assemblies capable of accomodating increased numbers of conductors.

An electrical plug in accordance with the invention comprises an insulating housing having a leading end and a conductor-receiving end which faces oppositely with respect to the leading end, oppositely facing first and second sidewalls and oppositely facing endwalls extending from the leading end to the conductor-receiving end. A conductor-receiving opening extends inwardly from the conductor receiving end towards the leading end; and contact-receiving cavities having plug terminals therein are provided in the housing at the leading end for contacting conductors extending into the conductor-receiving opening. The plug connector is characterized in that each of the endwalls has a latch arm associated therewith, each latch arm having a fixed end and a free end, the fixed end being integral with the endwall adjacent to the leading end of the housing and the free end being proximate to the conductor-receiving end of the housing. Each latch arm extends divergently from its associated endwall from the fixed end to the free end. Each latch arm has a single rearwardly facing latching shoulder thereon intermediate its ends and has a handle portion extending from the latching shoulder to its free end. Each latch arm has an ear on its free end extending laterally towards the associated endwall, each ear being offset relative to its associated latch arm and lying in a plane which is parallel to, and spaced from one of the sidewalls, each ear substantially closing the gap between the free end of the latch arm and the associated endwall of the housing.

In accordance with further embodiments, the latching shoulders are in a medial plane which is parallel to, and between, the housing sidewalls and each latch arm has a single handle portion which is proximate the housing sidewall. Each latch arm has a forward portion which extends from the shoulder to the fixed end, the forward portion having a thickness, as measured normally of the planes of the housing sidewalls, which is less than the thickness of the housing, as measured between the housing sidewalls, and is at least one-half the thickness of the housing, the handle portion of each latch arm having a thickness which is less than the thickness of the forward portion by an amount equal to the thickness of the shoulder.

In accordance with a further embodiment, a receptacle is provided for a connector plug as described above, the receptacle comprising a receptacle housing having a mating face and having a plug-receiving opening extending into the receptacle housing from the mating face, the plug-receiving opening having opposed first and second opening sidewalls and opposed opening endwalls, the plug-receiving opening being dimensioned to receive the plug, leading end first, with the first and second plug sidewalls opposed to the first and second opening sidewalls respectively. The electrical connector assembly is characterized in that the opposed opening endwalls have aligned receptacle shoulders thereon facing inwardly of the plug-receiving opening, the plug receiving opening having an intermediate width portion which is of an intermediate width, as measured between the opening endwalls, at the mating face in the vicinity of the receptacle shoulders, the plug receiving opening having a reduced width portion which is of a reduced width in the zone between the receptacle shoulders and the second opening sidewall, and the plug-receiving opening having an enlarged width portion which is of an enlarged width in the zone between the receptacle shoulders and the first opening sidewall, the opening being symmetrical about a medial plane extending normally of the opening sidewalls. The plug shoulders are engageable with the receptacle shoulders upon insertion of the plug into the plug-receiving opening, the handle portions being of reduced thickness, as measured normally of the plug housing sidewalls and being offset from the shoulders towards the second plug housing sidewall; parts of the handle portions, which are adjacent to the shoulders, being received in the enlarged width portion of the plug-receiving opening, the free ends of the latch arms being external to the plug-receiving opening to permit flexure of the latch arms towards the plug endwalls, disengagement of the plug shoulders from the receptacle shoulders, and removal of the plug from the receptacle.

DESCRIPTION OF THE DRAWINGS

FIG. 1 shows a plug 2 and a receptacle 4, the receptacle being mounted on the upper surface of a circuit board 8 and the plug having a cable 6 extending into its conductor receiving end. In this embodiment, the connector assembly serves to connect conductors in the cable 6 to conductors on the underside of the circuit board 8. The circuit board is mounted adjacent to a panel 10 in which the mating face of the receptacle is located.

Figure 1:
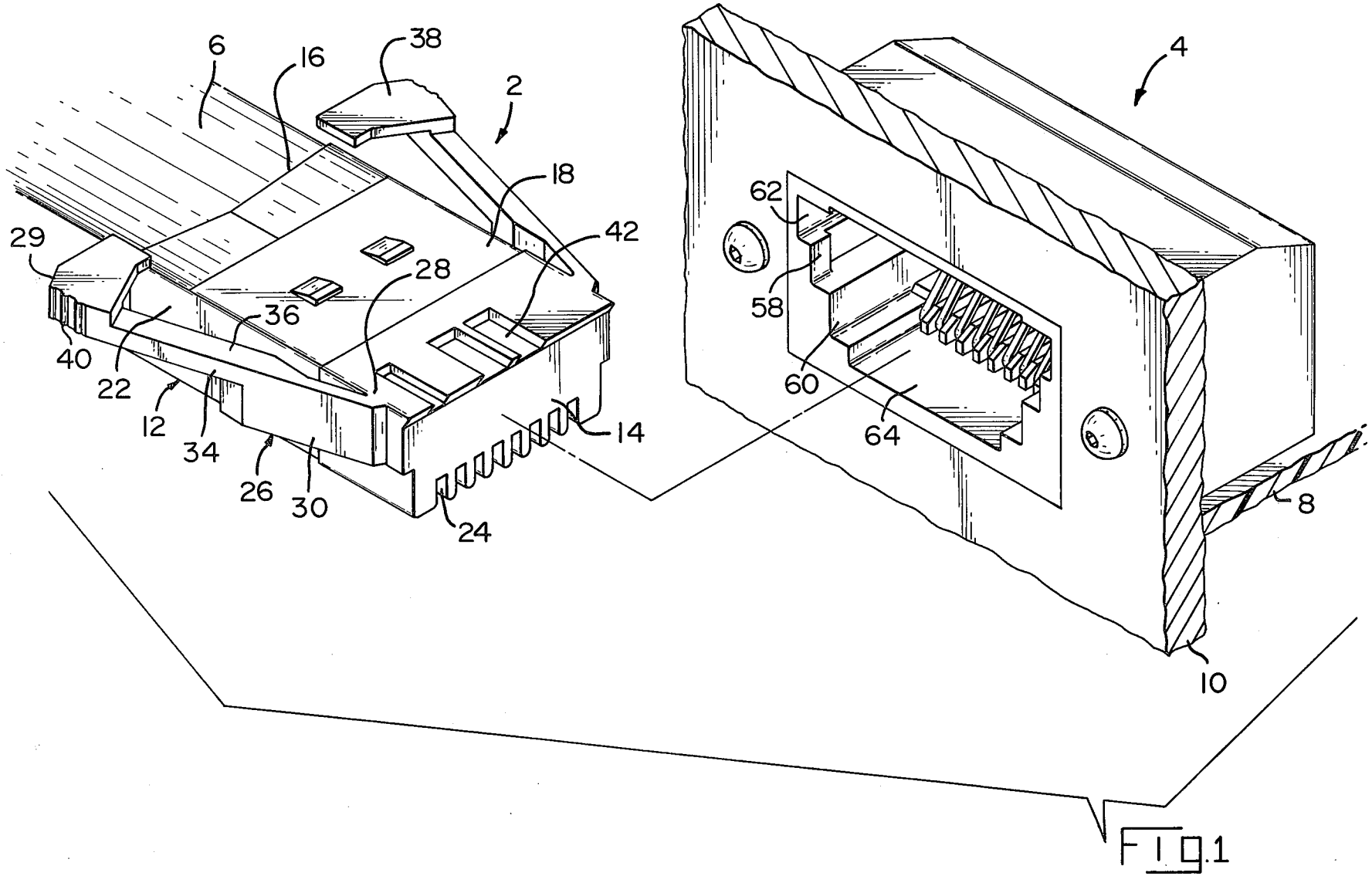
FIG. 1 is a perspective view of a connector assembly in accordance with the invention, the plug being exploded from, and offset from, the receptacle.

The plug 2 comprises a plug housing 12 having a leading end 14, a conductor receiving end 16 which faces oppositely with respect to the leading end, a first or upper plug housing sidewall 18, a second or lower plug housing sidewall 20, and oppositely facing plug housing endwalls 22. A plurality of side-by-side cavities 24 extend inwardly from the second housing sidewall 20 adjacent to the leading end and having terminals 25 therein which contact terminals in the receptacle.

Figure 2:
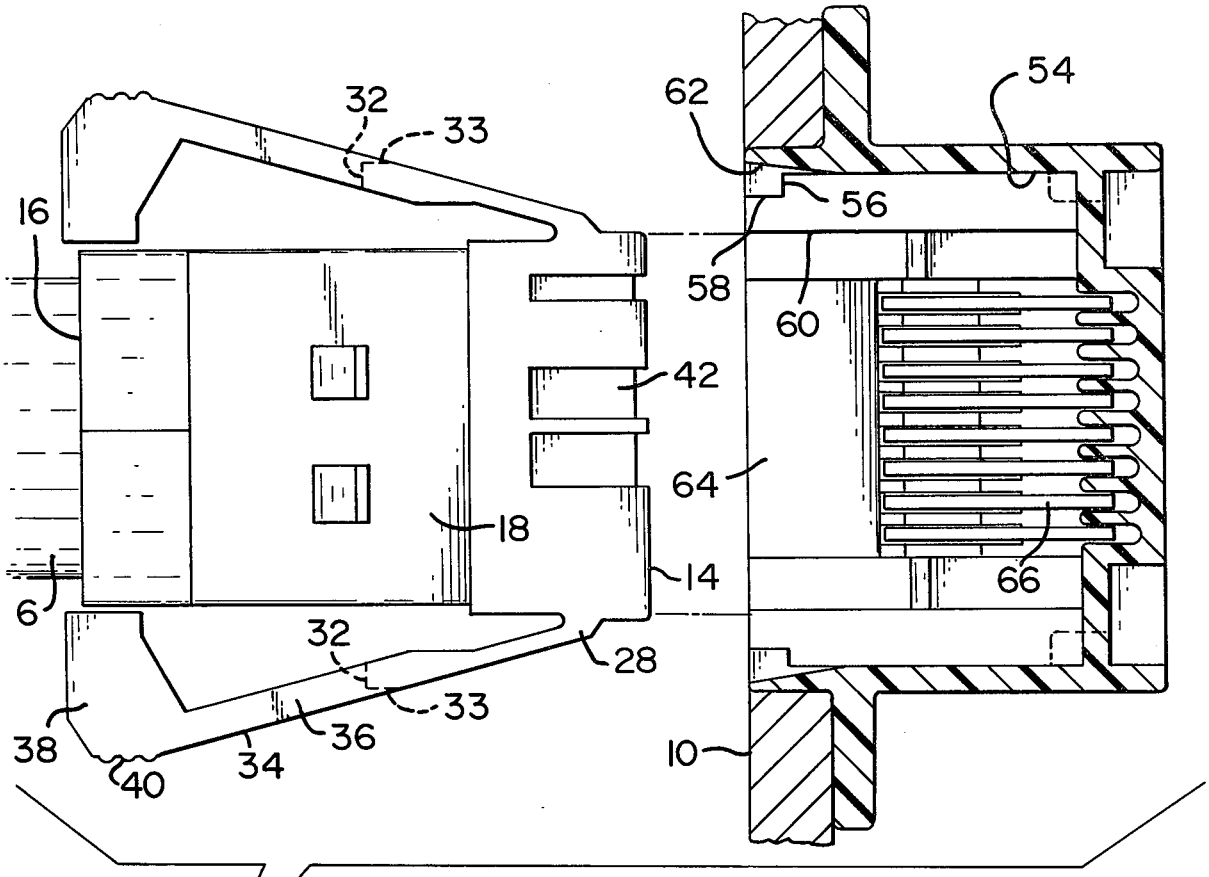
FIG. 2 is a plan view showing the plug in alignment with the receptacle, the receptacle being shown in cross section.
Figure 3:
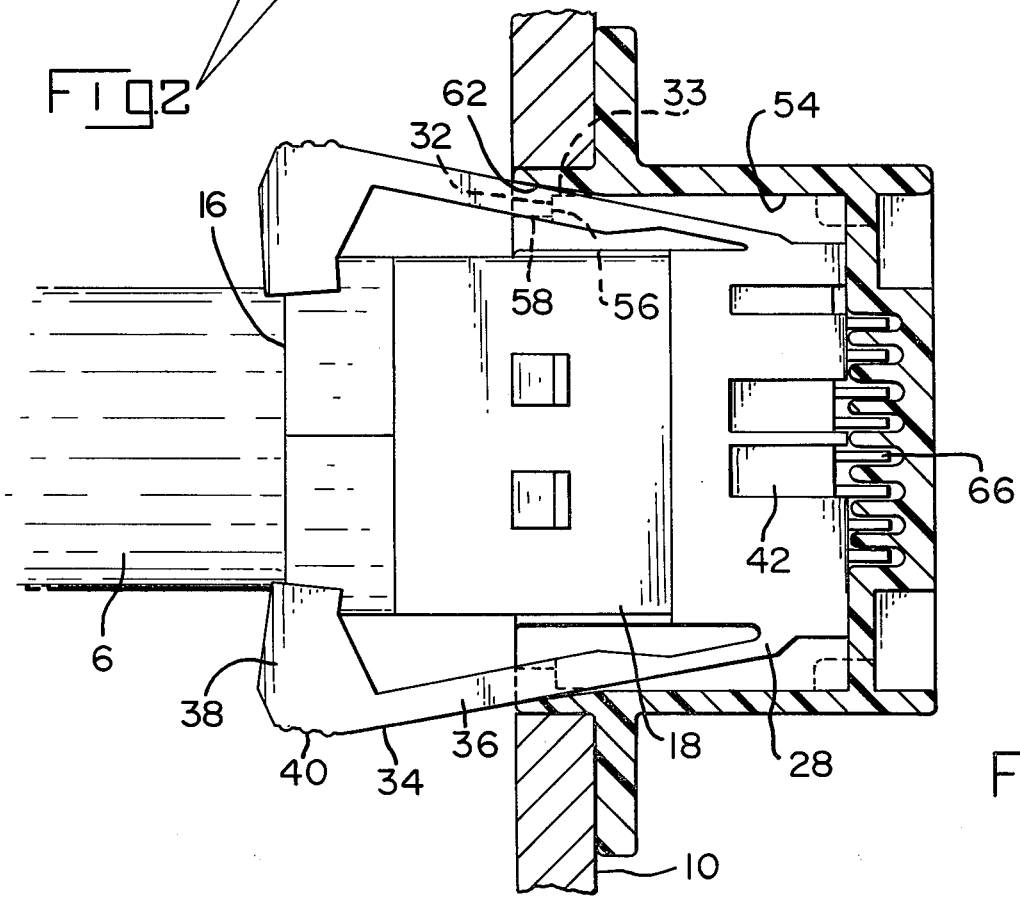
FIG. 3 is a view similar to FIG. 2 showing the positions of the parts when the plug is inserted into the receptacle.
Figure 4:
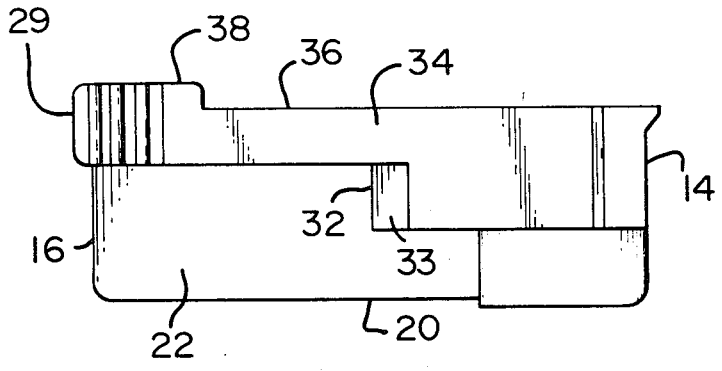
FIG. 4 is a side view of the plug.

Latch arms 26 extend from the endwalls 22 of the plug housing, each latch arm having a fixed end 28 and a free end 29 which is adjacent to and which may extend beyond the conductor receiving end 16 of the housing. Each latch arm has a forward portion 30 that extends from the fixed end 28 to an intermediate rearwardly facing plug shoulder 32, FIG. 2. The forward portion is relatively thick as measured in a vertical direction in the drawing or as measured normally of the planes of the sidewalls 18, 20. This forward portion has a thickness less than the thickness of the plug housing 12 and does not extend to the plane of the second or lower sidewall 20. The plug shoulder 32 is in a medial plane substantially midway between the first and second housing sidewalls 18, 20. The outside surface of each latch arm has a portion 33 adjacent to the shoulder which extends parallel to the plug axis. This surface portion provides clearance for the endwall as shown in FIG. 3.

Each latch arm 26 has a handle portion 34 that extends from the shoulder 32 to the free end 29, these handle portions being of reduced thickness as compared with the forward portion and being proximate to the first sidewall 18. The upper surfaces 36 of the handle portions may be substantially coplanar with the surface of the first sidewall 18 and the handle portions have ears 38 on their ends which extend towards each other and towards the housing endwalls 22. The ears are offset from the handle portions 34 and lie in a plane which extends parallel to, but which is spaced from, the plane of the first sidewall 18 so that the latch arms can be flexed towards the housing endwalls and the ears will move partially across the surface of the first sidewall 18. When the parts are in their normal positions, FIGS. 1 and 2, the ears substantially close the gap between the free ends of the latch arms and the endwalls 22 of the housing. The ears may have ribs 40 on the outwardly facing surfaces to facilitate grasping of the ears when they are flexed inwardly during mating or un-mating.

Figure 5:
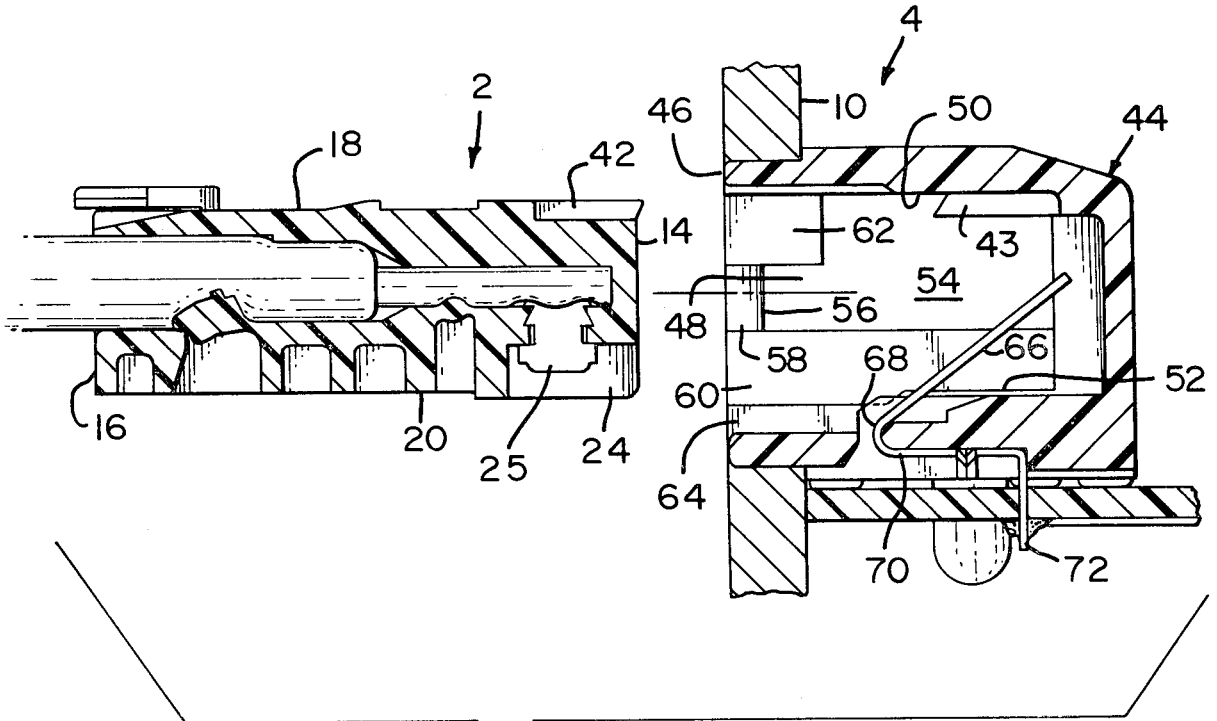
FIG. 5 is a sectional side view showing the plug in alignment with the receptacle.

The first sidewall may have keyways 42 therein extending rearwardly from the leading end of the housing which are dimensioned to receive complementary keys 43 in the plug receiving opening of the receptacle as shown in FIG. 5.

The receptacle 4 comprises a receptacle housing 44 having a mating face 46 into which a plug receiving opening 48 extends. This opening has a first or upper opening sidewall 50, a second or lower opening sidewall 52, and opposed opening endwalls 54. The first and second opening sidewalls are opposed to the first and second plug sidewalls respectively when the parts are mated and the plug endwalls are adjacent to the opening endwalls 54.

Receptacle shoulders 56 are provided in the opening endwalls 54 which are recessed from, but adjacent to, the mating face 46 and are between the first and second opening sidewalls 50, 52. The plug receiving opening is of an intermediate width at the mating face in the vicinity of the shoulders as shown at 58 and the opening has a portion of reduced width 60 adjacent to the mating face which is below the portion 58 as viewed in FIG. 5. The plug receiving opening is of increased width as shown at 62 in a zone adjacent to the mating face 46 and between the shoulders 56 and the first opening sidewall 50. As shown in FIG. 2, the sidewalls slope inwardly from the mating face in this increased width portion 62 for the accomodation of the divergent latch arms on the plug. The lower portion 64 of the plug receiving opening is of a still further reduced width. This part of the opening does not receive the plug when the parts are mated.

The receptacle contact terminals have cantilever spring arms 66 which extend from the second opening sidewall 52. Each of these contact terminals comprises a single strip of sheet metal which is reversely bent at 68 and which extends rearwardly as shown at 70 in a recess in the underside of the receptacle housing. The end portion 72 of each contact member extends through an opening in the circuit board 8 and is soldered to a conductor on the underside of the circuit board.

When the plug is to be mated with the receptacle, it is merely necessary to align the leading ear of the plug with the opening 48 and push the plug into the opening. The proper orientation for mating of the parts is immediately apparent from the stepped appearance of the plug receiving opening as shown in FIG. 1 and the technician will instinctively orient the plug with the latch arms uppermost as viewed in FIG. 1. When the plug is inserted, an audible click is experienced which indicates that the parts are properly mated.

As shown by FIG. 2, the distance between the two plug shoulders 32 when the latch arms are in their normal positions is greater than the distance between the receptacle shoulders 56 so that when the parts are mated, the latch arms will be held in an inwardly flexed condition and the ends of the ears 38 will overlap and extend inwardly beyond the housing endwalls 22. Since the latch arms are in a flexed condition in FIG. 3, they have a tendency to return to their normal positions and the parts will remain engaged with each other.

The provision of the ears 38 on the latch arms is advantageous in that these ears prevent any foreign object from moving between the latch arms and the endwalls of the plug housing 12. As will be explained below, the latch arms are quite small and could be damaged if the cable 6 should be pulled and one of the ears were to encounter a stationary object such as a handle of an equipment rack. The ears 38 would cause the end portion of the cable including the plug to be deflected from the stationary object such as a part of an equipment rack and damage is thereby avoided.

The medial location of the shoulders on the plug and in the receptacle is desirable in that if a light strain is imposed on the cable 6 when the parts are mated, the strain will be resisted by the shoulders and the restraining forces will be centrally directed against the latch arm rather than being off center relative to the latch arms.

Connector plugs are shown in FIG. 1 can be provided in a variety of sizes having greater numbers of contact terminals therein than are shown in FIG. 1. For example, connectors having as many as twenty-six terminals therein can be produced and would be significantly wider between endwalls than the plug shown in FIG. 1. Notwithstanding the increased width of the plug, the provision of the two latch arms on the endwalls is sufficient to latch the plug to a complementary housing.

Latch arms as shown in FIG. 1 are durable and are resistant to damage even when the plug and the latch arms are produced in relatively small sizes. One specific connector plug in accordance with the invention has a thickness as measured between the sidewalls 18, 20 of 7.6 mm. The thickness of the handle portion of each latch arms is 2.5 mm and the ears have a thickness of about 0.9 mm. It can be seen that latch arms having these dimensions might easily be damaged but damage is avoided under most circumstances in the event of abusive or careless handling by the provision of the ears and the arrangement of the latch arms on the housing endwalls.

We claim:

1. An electrical plug of the type comprising an insulating housing having a leading end and a conductor-receiving end which faces oppositely with respect to the leading end, oppositely facing first and second sidewalls and oppositely facing endwalls extending from the leading end to the conductor-receiving end, a conductor-receiving opening extending inwardly from the conductor receiving end towards the leading end, and contact-receiving cavities having plug terminals therein are provided in the housing at the leading end for contacting conductors extending into the conductor-receiving opening, the plug connector being characterized in that:

each of the endwalls has a latch arm associated therewith, each latch arm having a fixed end and a free end, the fixed end being integral with the endwall adjacent to the leading end of the housing and the free end being proximate to the conductor-receiving end of the housing, each latch arm extending divergently from its associated endwall from the fixed end to the free end, each latch arm having a single rearwardly facing latching shoulder thereon intermediate its ends and having a handle portion extending from the latching shoulder to its free end, each latch arm having an ear on its free end extending laterally towards the associated endwall, each ear being offset relative to its associated latch arm and lying in a plane which is parallel to, and spaced from one of the sidewalls, each ear substantially closing the gap between the free end of the latch arm and the associated endwall of the housing whereby, the latch arm can be flexed towards the housing endwalls and the ears will move past the endwalls and partially across the one sidewall.

2. An electrical plug connector as set forth in claim 1 characterized in that the latching shoulders are in a medial plane which is parallel to, and between, the housing sidewalls.

3. An electrical plug as set forth in claim 2 characterized in that each latch arm has a single handle portion which is proximate the one housing sidewall.

4. An electrical plug as set forth in claim 3 characterized in that each latch arm has a forward portion which extends from the shoulder to the fixed end, the forward portion having a thickness, as measured normally of the planes of the housing sidewalls, which is less than the thickness of the housing, as measured between the housing sidewalls, and is at least one-half the thickness of the housing, the handle portion of each latch arm having a thickness which is less than the thickness of the forward portion by an amount equal to the thickness of the shoulder.

5. An electrical connector assembly comprising a plug and a receptacle, the plug comprising an insulating plug housing having a leading end and a conductor-receiving end which faces oppositely with respect to the leading end, oppositely facing first and second plug sidewalls and oppositely facing plug endwalls extending from the leading end to the conductor-receiving end, a conductor-receiving opening extending inwardly from the conductor-receiving end towards the leading end, and contact-receiving cavities in the plug housing at the leading end and plug contact terminals in the cavities for contacting conductors extending into the conductor-receiving opening, the receptable comprising a receptacle housing having a mating face and having a plug-receiving opening extending into the receptacle housing from the mating face, the plug-receiving opening having opposed first and second opening sidewalls and opposed opening endwalls, the plug-receiving opening being dimensioned to receive the plug, leading end first, with the first and second plug sidewalls opposed to the first and second opening sidewalls respectively, the electrical connector assembly being characterized in that:

the opposed opening endwalls have aligned receptacle shoulders thereon facing inwardly of the plug-receiving opening, the plug receiving opening having an intermediate width portion which is of an intermediate width, as measured between the opening endwalls, at the mating face in the vicinity of the receptacle shoulders, the plug receiving opening having a reduced width portion which is of a reduced width in the zone between the receptacle shoulders and the first opening sidewall, and the plug-receiving opening having an enlarged width portion which is of an enlarged width in the zone between the receptacle shoulders and the second opening sidewall, the opening being symmetrical about a medial plane extending normally of the opening sidewalls, the plug has a pair of latch arms extending from the endwalls thereof, each latch arm having a fixed end and a free end, the fixed end being integral with the plug endwall adjacent to the leading end of the plug housing and the free end being proximate to the conductor-receiving end of plug housing, each latch arm extending divergently from its associated plug endwall from the fixed end to the free end, each latch arm having a rearwardly facing plug shoulder thereon intermediate its ends and having a handle portion extending from the plug shoulder to its free end, the plug shoulders being engageable with the receptacle shoulders upon insertion of the plug into the plug receiving opening, the handle portions being of reduced thickness, as measured normally of the plug housing sidewalls and being offset from the shoulders towards the second plug housing sidewall, parts of the handle portions, which are adjacent to the shoulders, being received in the enlarged width portion of the plug receiving opening, the free ends of the latch arms being external to the plug-receiving opening to permit flexure of the latch arms towards the plug endwalls, disengagement of the plug shoulders from the receptacle shoulders, and removal of the plug from the receptacle each latch arm having an ear on its free end extending towards the associated plug housing endwall, each ear being offset relative to its associated latch arm and lying in a plane which is parallel to, and spaced from, the first plug housing sidewall, each ear substantially closing the gap between the free end of the latch arm and the associated endwall of the housing.

6. An electrical connector assembly as set forth in claim 5 characterized in that the distance between the receptacle shoulders is less than the distance between the plug shoulders whereby upon insertion of the plug into the plug-receiving opening of the receptacle, the latch arms will be held in a flexed condition and the plug shoulders are resiliently biased into engagement with the receptacle shoulders.

7. An electrical connector assembly as set forth in claim 6 characterized in that the contact-receiving cavities in the plug housing extend into the housing from the second plug housing sidewall and the plug contact terminals have contact portions which are proximate to the second plug housing sidewall, the receptacle having cantilever spring arms which extend from the second opening sidewall and which are contacted by the contact portions of the plug terminals.

* * * * *